US005404211A

United States Patent [19]

Hashimoto et al.

[11] Patent Number: 5,404,211

[45] Date of Patent: Apr. 4, 1995

[54] DEVELOPING DEVICE INCLUDING DEVICE FOR SELECTING VARYING THE THICKNESS OF THE DEVELOPING AGENT

[75] Inventors: Yoshiya Hashimoto, Yokohama; Osamu Takagi, Tokyo; Takao Izumi; Toshihiro Kasai, both of Yokohama; Shoko Seto, Kawasaki, all of Japan

[73] Assignee: Kabushiki Kaisha Toshiba, Kawasaki, Japan

[21] Appl. No.: 124,456

[22] Filed: Sep. 22, 1993

[30] Foreign Application Priority Data

Jan. 28, 1993 [JP] Japan ..... 5-012733

[51] Int. Cl.[6] ..... G03G 15/06

[52] U.S. Cl. ..... 355/259; 118/661

[58] Field of Search ..... 355/245, 259; 118/661

[56] References Cited

U.S. PATENT DOCUMENTS

| | | | |
|---|---|---|---|
| 4,835,565 | 3/1989 | Nagatsuna et al. | 355/259 |
| 4,958,193 | 9/1990 | Nojima et al. | 355/259 |
| 5,097,294 | 3/1992 | Nishio et al. | 355/259 X |
| 5,168,312 | 12/1992 | Aoto et al. | 355/259 |
| 5,223,668 | 6/1993 | Takaya et al. | 355/259 X |

FOREIGN PATENT DOCUMENTS 60-103367 6/1985 Japan .

OTHER PUBLICATIONS

Chikara Imai, "Single-Component Contact Development", Magazine Issued by the Society of Electrophotography of Japan, Imaging Technology Research Center, vol. 3, No. 2, pp. 183-193, (1991).

Masahiro Hosoya et al., "Contact-Type Development System Using Monocomponent Nonmagnetic Toner", Japan Hardcopy 89, Proceedings of the annual conference of Japan Hardcopy for the Society of Electrophotography of Japan, pp. 25-28, (1989).

*Primary Examiner*—Fred L. Braun

*Attorney, Agent, or Firm*—Foley & Lardner

[57] ABSTRACT

A developing roller is opposed to a photosensitive drum on which a latent image is carried, and developer supplied to the latent image is held and fed by the developing roller. Developer is supplied from a feeding roller to the developing roller. A thickness defining blade is pressed against the feeding roller to press the feeding roller against the developing roller and form a developer layer of certain thickness on the feeding roller. A developing device thus arranged enables developer to be electrically charged without adding any stress to the developer, and a developer layer of certain thickness to be formed.

5 Claims, 4 Drawing Sheets

DEVELOPING DEVICE INCLUDING DEVICE FOR SELECTING VARYING THE THICKNESS OF THE DEVELOPING AGENT

BACKGROUND OF THE INVENTION

1. Field of the Invention

The present invention relates to a developing device for making electrostatic or magnetic latent images visible with toner powder.

2. Description of the Related Art

The developing device is usually intended to supply developer to a photosensitive drum while rotating a developing roller, and make latent images visible with developer thus supplied. In a conventional developing device, a metal blade is usually pressed against the developing roller to charge the developer and thin it to a certain thickness. As disclosed in a Japanese Patent Application H1-124880, there is disclosed a roller type restricting member for restricting the thickness of the developer layer. In this restricting member, a relatively thin developing layer is formed on the developing roller. Thus, a sufficient developing density can not be obtained in respect to a developing process. In the case of the conventional developing device of this kind, stress is likely to be added to the developer. Particularly, when a non-magnetic developer is used, its hardness and its melting point are low. When the metal blade is pressed against the developing roller, therefore, the developer is degraded and melted.

SUMMARY OF THE INVENTION

The object of the present invention is therefore to provide a developing device capable of charging a developer and making it a thin layer of certain thickness, without adding any stress to it.

According to an aspect of the present invention, there can be provided a developing apparatus for developing with a developing agent a latent image on an image carrying body, by rotating a developing roller in a predetermined direction, comprising: means for storing the developing agent, the storing means having an opening for supplying the developing agent therefrom; a supplying roller located between the opening of the storing means and the developing roller, for supplying the developing agent stored in the storing means to the developing roller through the opening to form a developing agent layer thereon, the supplying roller rotating in the same direction as the rotating direction of the developing roller; a conveying roller, opposed to the developing roller and the supplying roller, for carrying the developing agent thereon to convey the developing agent to the developing roller, the conveying roller rotating in the same direction as the rotating direction of the developing roller; and means, opposed to the conveying roller, for forming a developing agent layer on the conveying roller; the developing agent layer on the conveying roller contacting the developing roller which carries the developing agent layer formed by the supplying roller, so as to form a layer of the developing agent having a thickness sufficient to develop the latent image on the developing roller; and the supplying roller and the conveying roller located around the developing roller in the predetermined direction.

According to another aspect of the present invention, there can be provided a developing apparatus for developing with a developing agent a latent image on an image carrying body, by rotating a developing roller having a center in a predetermined direction, comprising: means for storing the developing agent, the storing means having an opening for supplying the developing agent therefrom; a supplying roller, having a center and located between the opening of the storing means and the developing roller, for supplying the developing agent stored in the storing means to the developing roller through the opening to form a developing agent layer thereon, the supplying roller rotating in the same direction as the rotating direction of the developing roller; a conveying roller, opposed to the developing roller and the supplying roller, for carrying the developing agent thereon to convey the developing agent to the developing roller, the conveying roller rotating in the same direction as the rotating direction of the developing roller; means, having an elastic member which is pressed against the conveying roller for forming a developing agent layer on the conveying roller; and supporting means for supporting the forming means so as to contact the forming means to the developing means on a straight line passing through centers of the developing roller and the supplying roller; the supporting means having pressing member for pressing the elastic member against, the conveying roller so as to press the conveying roller against the developing roller so that the developing agent layer having a predetermined thickness is formed on the first roller; the developing agent layer on the conveying roller contacting the developing roller which carries the developing agent layer formed by the supplying roller so as to form a layer of the developing agent having a thickness sufficient to develop the latent image on the developing roller; and supplying roller and the conveying roller located around the developing roller in the predetermined direction.

According to a further aspect of the present invention, there can be provided a developing apparatus for developing with a developing agent a latent image on an image carrying body, by rotating a developing roller in a predetermined direction, comprising: means for storing the developing agent, the storing means having an opening for supplying the developing agent therefrom; a supplying roller, located between the opening of the storing means and the developing roller, for supplying the developing agent stored in the storing means to the developing roller through the opening to form a developing agent layer thereon, the supplying roller rotating in the same direction as the rotating direction of the developing roller; a conveying roller, opposed to the developing roller and the supplying roller, for carrying the developing agent thereon to convey the developing agent to the developing roller, the conveying roller rotating in the same direction as the rotating direction of the developing roller; pressing means for pressing the conveying roller against the supplying roller under a predetermined pressing force; adjusting means for adjusting the pressing force of the pressing means so as to form the developing agent layer having a predetermined thickness; and means, opposed to the conveying roller, for forming a developing agent layer on the conveying roller; the developing agent layer on the conveying roller contacting the developing roller which carries the developing agent layer formed by the supplying roller so as to form a layer of the developing agent having a thickness sufficient to develop the latent image on the developing roller; and the supplying roller and the conveying roller located around the developing roller in the predetermined direction.

A composite developing layers of first and second layers are formed on the developing roller, the first layer being formed between the developing roller and the supply roller and the second layer formed on the supply roller and the first and second layer being supplied to the developing roller, the developer supply means is elastically pressed by the thickness defining means. The developer supply means thus elastically contacts the developer holder means to charge the developer and thin it to a certain thickness, without adding any stress to it.

Further, the point at which the thickness defining means contacts the developer supply means, the centers of the developer supply and holder means are arranged substantially on a straight line. Thinning the developer on the developer supply means and controlling the pressing force of the developer supply means against the developer holder means and adjusting the gap between the developer supply means and the developer holder means can be, therefore, achieved by a single mechanism.

Furthermore, the pressing force of the pressing means with which the developer supply means is elastically pressed against the developer holder means is made variable. The developer supply means can be therefore pressed against the developer holder means with any desired force. This enables the layer of developer formed to have the desired thickness desired.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

A modification of the developing device according to the present invention will be described referring to FIG. 1.

Figure 1:
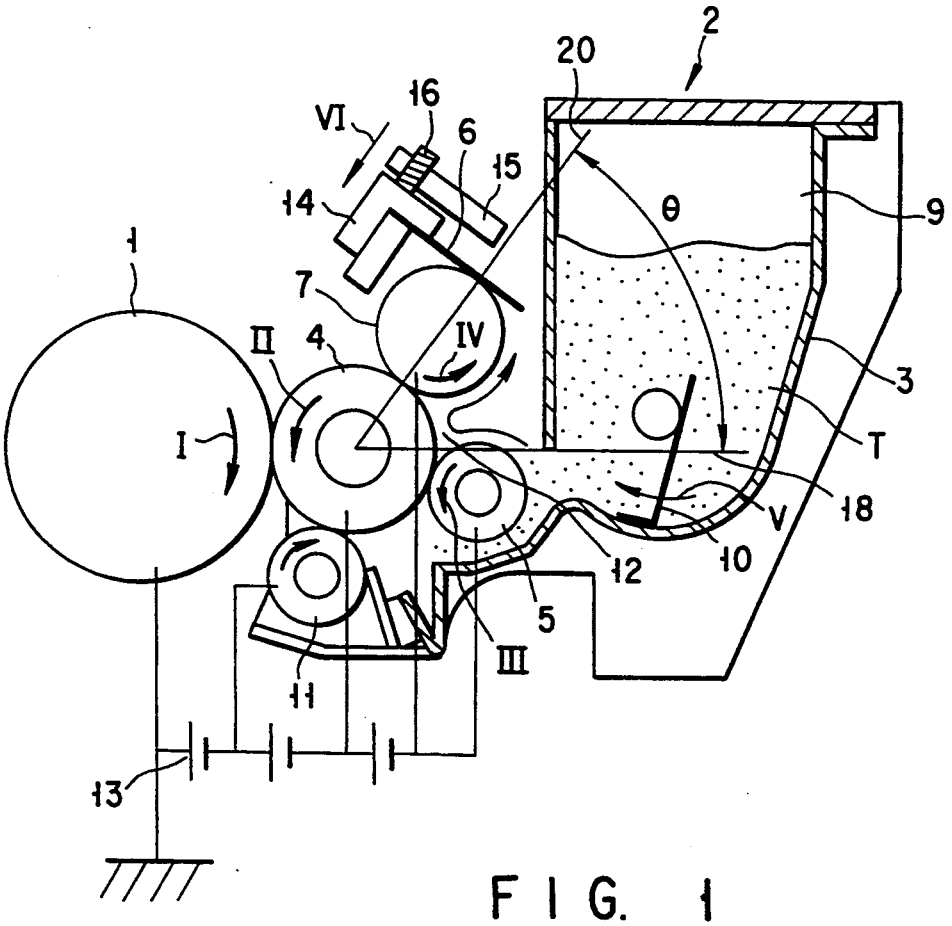
FIG. 1 is a system view showing a developing device according to one embodiment of the present invention.

FIG. 1 is a sectional view showing the developing device in which a single component developer contact type is used. That is, a single component developer or toner in which no carrier is mixed is in directly contact with a photosensitive drum.

In FIG. 1, reference numeral 1 represents the photosensitive drum which serves as a latent image carrier. This photosensitive drum 1 is rotated in a direction, which is shown by an arrow I, by a drive mechanism (not shown). A developing unit 2, from which developer or toner is supplied, is opposed to the photosensitive drum 1. It includes a toner containing and supplying vessel 3. A developing roller 4 is arranged adjacent to the developer vessel 3 and freely rotatable in a direction shown by an arrow II to hold and feed developer to the photosensitive drum 1. The roller 4 contacts the photosensitive drum 1.

First and second feeding rollers 5 and 7 (sometimes, respectively, the supplying and conveying rollers) are arranged round the developing roller 4 in the rotating direction II and they are rotated in directions shown by arrows III and IV while contacting the developing roller 4. A toner containing section 9 is arranged in the developer vessel 3. Developer or toner T is contained in the toner containing section 9 and a mixer 10 for mixing or stirring toner T is arranged, freely rotatable in a direction shown by an arrow V.

Figure 2:
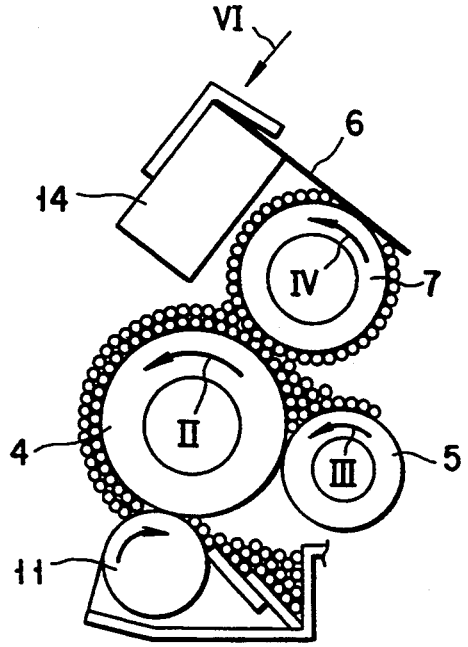
FIG. 2 is a partial enlarged view of the developing device shown in FIG. 1.

An elastic blade 6 for defining the thickness of developer fed is pressed against the second feeding roller 7. The elastic blade 6 is fixed to a blade holder 14, with which a set screw 16 held by a fixed portion 15 is contacted. The pressing force applied from the blade holder 14 to the feeding roller 7 can be adjusted by screwing the set screw 16. A load, therefore, acts on the blade 6 in a direction shown by an arrow VI to press it against the second feeding roller 7. As the result, developer or toner T fed between the blade 6 and the second feeding roller 7 can be made uniformly thin, as shown in FIG. 2. The thickness defining elastic blade 6 presses the second feeding roller 7 against the developing roller 4 with a certain force. Toner fed on the developing roller 4 can be thus a selected amount and charged to a predetermined polarity.

The centers of the second feeding and developing rollers 7 and 4 are on a straight line 20 which is tilted relative to a horizontal reference line 18 by an angle $\theta$. The line 20 coincides substantially with the normal of the thickness defining blade 6. In other words, the point at which the blade 6 contacts the second feeding roller 7, and the centers of the second feeding and developing rollers 7 and 4 lie substantially on the straight line 20.

In the case of the above-described developing device, the electrostatic latent image on the photosensitive drum 1 is developed as follows by developer supplied from the developing unit 2. The mixer 10 is rotated in the direction V and toner T of single component is fed to the first feeding roller 5 while being stirred by the rotating mixer 10. Toner T, thus fed to the first feeding roller 5, is fed onto the developing roller 4, as shown in FIG. 2, as the first feeding roller 5 is rotated in the anti-clockwise direction II. As the developing roller 4 is rotated in the anti-clockwise direction II, toner T is fed to the inlet side of that area where the roller 4 contacts the second feeding roller 7. A part of toner T thus fed comes out of the outlet side of the contacted area between the second feeding and developing rollers 7 and 4, to which a certain force is applied each, passing between them. Toner T thus fed from the outlet side of the contacted area, as shown in FIG. 2, forms a first toner layer on the developing roller 4 and this first toner layer is further fed together with the rotating developing roller 4.

The remaining part of toner T is transferred onto the second feeding roller 7 at the contacted area and a layer of toner is thus formed on the second feeding roller 7. As the second feeding roller 7 is rotated, this toner layer is again fed to the outlet side of the contacted area, as shown in FIG. 2, passing between the thickness defining blade 6 and the second feeding roller 7. The toner layer on the second feeding roller 7, thus fed, is transferred there, as a second toner layer, onto the first toner layer on the developing roller 4.

DC bias voltage is applied to the first and second feeding rollers 5 and 7 by bias applying means 13.

As the developing roller 4 is rotated, the toner layers on it are fed to that position which is opposed to the photosensitive drum 1, and a charged pattern on the drum 1 is developed by the toner layers thus fed.

Toner vortexes are generated by flows of toner caused by the mixer 10, the first feeding roller 5, the developing roller 4 and the second feeding roller 7. When the generation of each of these toner vortexes is controlled by the rotating number of each of the above-mentioned components, the amount of toner entering between the developing and second feeding rollers 4 and 7 can be controlled to reduce stress added to toner. Excessive toner can be removed by the toner vortexes and as the second feeding roller 7 is rotated in the anti-clockwise direction IV, toner is defined in amount by the thickness defining blade 6. Toner is thus made thin and charged to have a predetermined polarity.

Toner T used in the above-described case has an average particle diameter of 6 μm and it is charged negatively. Organic photosensitive matter is used as the drum 1, which has a surface potential of −550 V. A developing bias voltage of −200 V is applied to the developing roller 4. The second feeding roller 7 is rotated in the same direction as the developing roller 4. In other words, they have "against-contact" between them. They also have a gap of 10–30 μm between them under a constant pressure load.

When the developing and second feeding rollers 4 and 7 contact each other under a constant load, the same effect could also be obtained.

The remaining toner on the developing roller 4 can also be removed when a roller 11 is located adjacent to the developing roller 4 and downstream the developing position in the toner feeding direction of the roller 4, and a bias voltage higher than that applied to the developing roller 4 is applied to the roller 11. When the gap between the developing roller 4 and the roller 11 is made zero in this case, toner remaining on the roller 4 can be more reliably removed.

The above is related to negatively charged toner and in the case of positively charged toner, bias voltage applied to the developing roller 4 has a value reverse to that of bias voltage applied in the case of negatively charged toner.

When it is assumed that the rotation number of the developing roller 4 is 1, the rotation speed of the first feeding roller 5 is set 1–2.5 times the rotation number of the developing roller 4 and that of the second feeding roller 7 is set 0.2–2 times the rotation number of the developing roller 4. When these rotation speeds are set in this manner, an optimum condition is produced.

The toner layer formed on the surface of the developing roller 4 can be made more stable and the amount of normally-charged toner fed can be increased to a greater extent under this optimum condition. The difference of peripheral speed of the developing roller 4 relative to that of the photosensitive drum 1 can be made smaller e.g. 1–1.5 times, as compared with the conventional difference of 1.5–2 times.

As it is pressed by the thickness defining blade 6, which is an elastic metal plate, the second feeding roller 7 can be elastically contacted with the developing roller 4 and developer on it can be made thin to have a uniform thickness, even when the developing roller 4 is made eccentric. Stress added to the developer can be thus made smaller. Further, making the developer on the second feeding roller 7 thin and controlling the pressure added from the second feeding roller 7 to the developing roller 4 and the gap between these two rollers 7 and 4 can be achieved by a single mechanism. This can reduce the number of components used to a greater extent.

Figure 3:
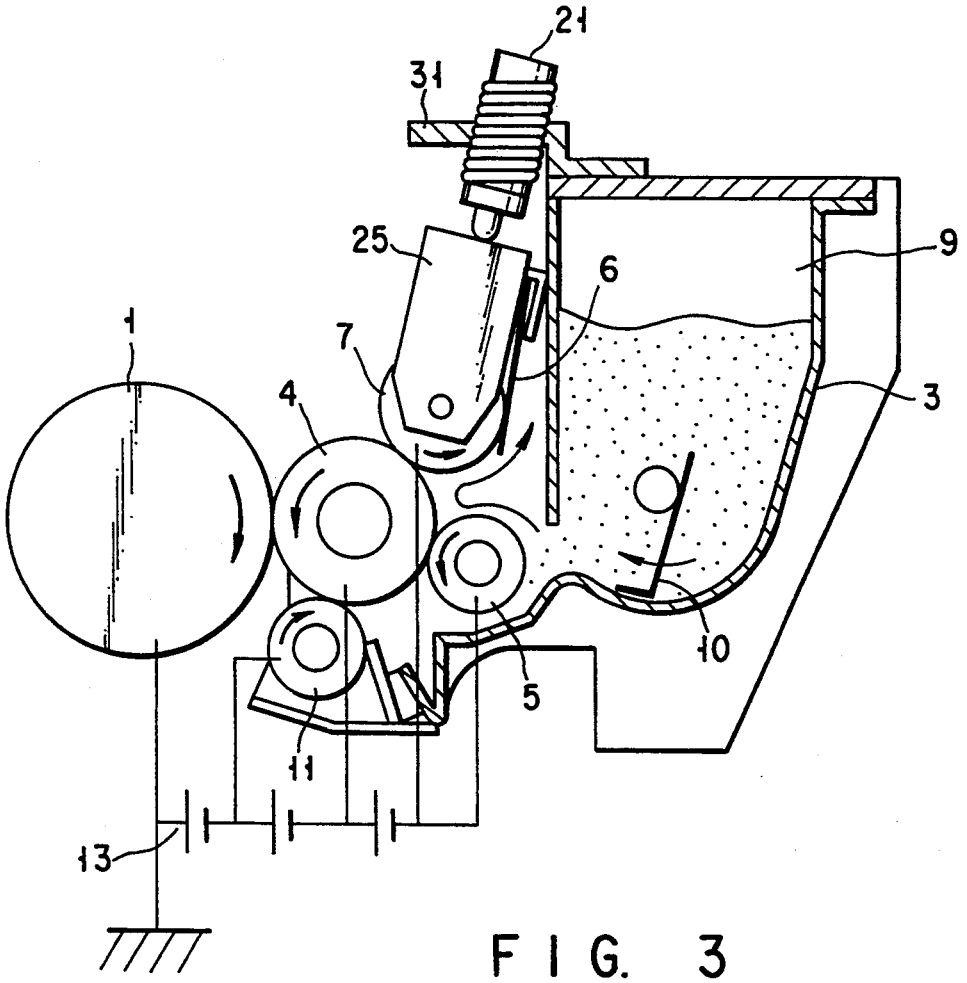
FIG. 3 is a system view showing the developing device according to another embodiment of the present invention.
Figure 6:
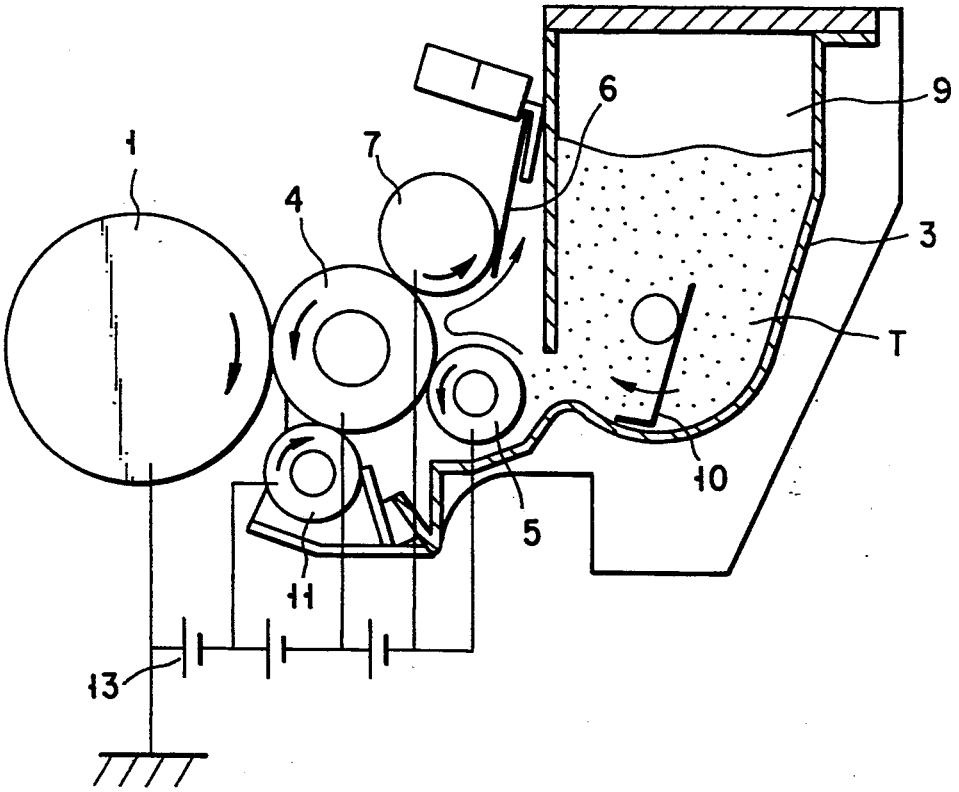
FIG. 6 is a system view showing the developing device according to a second another embodiment of the present invention.

The present invention is not limited to the above-described embodiment but it may be embodied in other ways as shown in FIGS. 3 and 6.

The same components as those of the above-described embodiment will be denoted by same reference numerals, and description on these components will be added only when needed.

Figure 5:
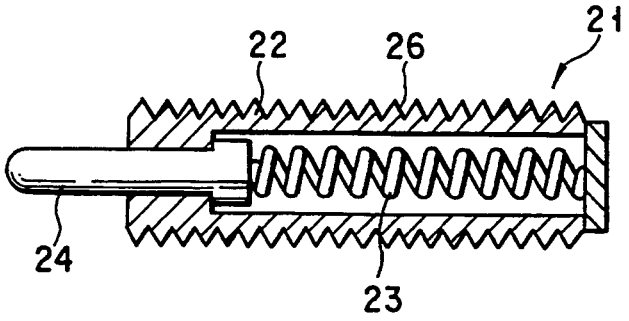
FIG. 5 is a sectional view showing spring plungers for pressing a conveying roller of the developing device in FIG. 3.

In the case of another embodiment of the present invention shown in FIG. 3, the second feeding roller 7 is made of rigid material and both ends of it are pressed by two spring plungers 21. When pressed in this manner, roller 7 contacts the developing roller 4 with a certain pressing force, to define the amount of toner fed on the developing roller 4 and to charge the toner to a predetermined polarity. As shown in FIG. 5, each of the spring plungers 21 includes a cylindrical member 22 provided with a thread 26 on the outer circumference thereof, a spring 23 housed in the cylindrical member 22, and a pin 24 attached to the front end of the spring 23. A block 25 (FIG. 3) for supporting the second feeding roller 7 is pressed by the pin 24. The cylindrical member 22 of each spring plunger 21 is screwed into the ceiling of the developer vessel 3 through an attaching member 31 (FIG. 3) it is rotated, the pressing force of the spring 23 is made variable.

Figure 4:
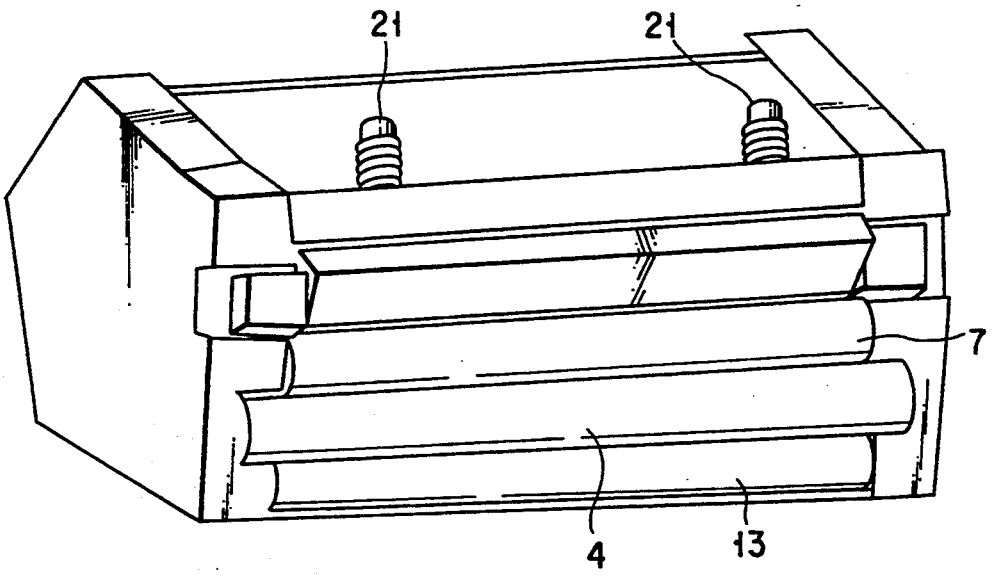
FIG. 4 is a perspective view showing the developing device in FIG. 3.

According to the embodiment shown in FIGS. 3 and 4, the second feeding roller 7 is pressed against the developing roller 4 by the spring plungers 21. The second feeding roller 7 and the developing roller 4 can be therefore elastically contacted with each other and even when the developing roller 4 become eccentric, developer can be made thin to have a uniform thickness. Stress added to developer can be thus made smaller. When the screwing of the cylindrical member 22 of each spring plunger 21 into the ceiling of the developer vessel 3 is adjusted, in other words, when pressing forces added from two plunger 21 are the same, pressing forces added from the second feeding roller 7 to the contact surfaces of the developing roller 4 can be made equal.

The developing device may be modified as shown in FIG. 6.

Figure 7:
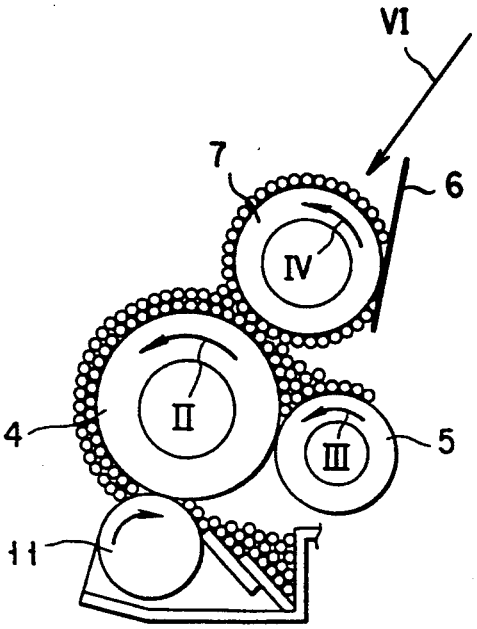
FIG. 7 is a partial enlarged view of the developing device shown in FIG. 6.

In the case of a variation of the developing device shown in FIG. 6, an elastic roller whose surface is made of elastic matter is used as the second feeding roller 7, when the second feeding roller 7 is made in this manner, stress added to developer can be made smaller. In addition, developer can be made thin to have a uniform thickness as shown in FIG. 7, even when the contact of the second feeding roller 7 with the developing roller 4 is changed and the developing roller 4 becomes eccentric, while sandwiching toner between the second feeding roller 7 and roller 4.

According to the present invention, one developing layer can be formed between the developing roller and the supply roller and the another developing layer can be formed between the supply roller and the restricting blade. The both layers are fed to the developing roller so that the composite layers having a sufficient thickness can be formed on the developing roller.

Furthermore, the developer supply means is elastically pressed by the thickness defining means to elastically contact the developer holder means. Charging and layer forming can be thus achieved without adding any stress to developer. In addition, the developer can be made thin to a uniform thickness, even when the developer holder means becomes eccentric.

Further, the point at which the thickness defining means is contacted by the developer supply means, and centers of the developer supply and holder means are located substantially on a straight line. Therefore, making developer on the developer supply means thin and controlling the pressing force of the developer supply means against the developer holder means and the gap between the developer supply and holder means can be achieved by a single mechanism. This enables the developing device to be made simpler in structure.

Furthermore, the pressing force of the pressing means with which the developer supply means is elastically pressed against the developer holder means is made freely variable. This enables the developer supply means to press against the developer holder means with any desirable force, to thin the developer on the developer holder means to any desirable thickness.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A developing apparatus for developing a latent image on an image carrying body with developing agent, the developing apparatus comprising:

a developing roller which rotates in a predetermined direction;

means for storing the developing agent, said storing means having an opening for supplying the developing agent therefrom;

a supplying roller located between the opening of said storing means and the developing roller, for supplying the developing agent stored in said storing means to said developing roller through the opening to form a developing agent layer thereon, said supplying roller rotating in the same direction as the rotating direction of the developing roller;

a conveying roller, opposed to said developing roller and said supplying roller, for carrying the developing agent thereon to convey the developing agent to said developing roller, said conveying roller rotating in the same direction as the rotating direction of the developing roller;

means having an elastic member pressed against the conveying roller, for forming a developing agent layer on the conveying roller; and supporting means for supporting the forming means so as to contact the forming means to the conveying roller on a straight line passing through the centers of the developing roller and the conveying roller, the line forming a predetermined angle with a horizontal line;

the supporting means having a pressing member for pressing the elastic member against the conveying roller so as to press the conveying roller against the developing roller so that the developing agent layer having a predetermined thickness is formed on the developing roller, wherein said pressing member includes means for holding the elastic member and a set screw provided on the holding means, the pressure applied to the elastic member being adjusted by screwing the set screw;

the developing agent layer on said conveying roller contacting the developing roller which carries the developing agent layer formed by said supplying roller, so as to form a layer of the developing agent having a predetermined thickness sufficient to develop the latent image on said developing roller; and said supplying roller and said conveying roller located around said developing roller in the predetermined direction.

2. A developing apparatus for developing a latent image on an image carrying body with developing agent, the developing apparatus comprising:

a developing roller which rotates in a predetermined direction;

means for storing the developing agent, said storing means having an opening for supplying the developing agent therefrom;

a supplying roller, located between the opening of said storing means and the developing roller, for supplying the developing agent stored in said storing means to said developing roller through the opening, to form a developing agent layer thereon, said supplying roller rotating in the same direction as the rotating direction of the developing roller;

a conveying roller, opposed to said developing roller and said supplying roller, for carrying the developing agent thereon to convey the developing agent to said developing roller, said conveying roller rotating in the same direction as the rotating direction of the developing roller;

pressing means for pressing the conveying roller against the developing roller under a predetermined pressing force;

adjusting means for adjusting the pressing force of the pressing means so as to form the developing agent layer having a predetermined thickness; and means, opposed to said conveying roller, for forming a developing agent layer on the conveying roller;

the developing agent layer on said conveying roller contacting the developing roller which carries the developing agent layer formed by said supplying roller so as to form a layer of the developing agent having a predetermined thickness sufficient to develop the latent image on said developing roller; and said supplying roller and said conveying roller located around said developing roller in the predetermined direction.

3. The developing apparatus according to claim 2, wherein said adjusting means includes a pair of spring plunger units; each unit having a hollow cylinder member provided with a thread, a spring received in the hollow cylinder member, and a pin attached to the spring, projected from the cylinder member, and contacted with the pressing means, a spring force being applied to the pressing means through the pins, and a fixing structure to which the cylinder member is screwed, the spring force being adjusted by rotating the cylinder member.

4. The developing apparatus according to claim 2, wherein the surface of said conveying roller is made of elastic matter.

5. The developing apparatus according to claim 2, wherein, when the developing roller is rotated at a first rate, the supplying roller is rotated at a second rate, which is set at 1 to 2.5 times the first rate, and the conveying roller is rotated at a third rate which is set at 0.2 to 2 times the first rate.

* * * * *